US009589457B1

(12) United States Patent
Wengreen

(10) Patent No.: US 9,589,457 B1
(45) Date of Patent: Mar. 7, 2017

(54) REMOTE CONTROL SYSTEMS AND METHODS

(71) Applicant: Brian Jeffrey Wengreen, Ravensdale, WA (US)

(72) Inventor: Brian Jeffrey Wengreen, Ravensdale, WA (US)

(73) Assignee: Mission Cables, LLC, Ravensdale, WA (US)

( * ) Notice: Subject to any disclaimer, the term of this patent is extended or adjusted under 35 U.S.C. 154(b) by 33 days.

(21) Appl. No.: 14/708,181

(22) Filed: May 8, 2015

Related U.S. Application Data

(60) Provisional application No. 62/144,286, filed on Apr. 7, 2015.

(51) Int. Cl.
*G08C 23/04* (2006.01)
*G08C 17/02* (2006.01)

(52) U.S. Cl.
CPC ..... *G08C 17/02* (2013.01); *G08C 23/04* (2013.01); *G08C 2201/10* (2013.01); *G08C 2201/92* (2013.01)

(58) Field of Classification Search
CPC ..... H05B 37/0272; H05B 33/0803; H05B 33/0842; G08C 23/04; G08C 17/02; G08C 2201/40; G08C 2201/50; H02J 7/0045; H02J 7/0042; H02J 7/0044; G06F 1/1626
See application file for complete search history.

(56) References Cited

U.S. PATENT DOCUMENTS

| | | | | |
|---|---|---|---|---|
| 4,866,434 | A | 9/1989 | Keenan | |
| 4,937,604 | A * | 6/1990 | Yoshida | G03B 17/38 396/56 |
| 7,290,654 | B2 | 11/2007 | Hodges | |
| 7,324,168 | B2 | 1/2008 | Griesau et al. | |
| D669,868 | S | 10/2012 | Bacchus | |
| 8,565,843 | B1 * | 10/2013 | Lugo | H04M 1/04 455/556.1 |
| 2007/0130607 | A1 | 6/2007 | Thissen et al. | |
| 2008/0266763 | A1 * | 10/2008 | Tanaka | H04M 1/0279 361/724 |
| 2009/0253508 | A1 * | 10/2009 | Koontz, II | G08C 23/04 463/37 |

(Continued)

OTHER PUBLICATIONS

Sideclick—Website—Downloaded on Jun. 8, 2015 from www.sideclickremotes.com.

(Continued)

*Primary Examiner* — James Yang

(57) ABSTRACT

A remote control system can comprise a first remote control having a front side, a backside, and a first battery configured to provide a first electrical power to the first remote control. The front side can comprise at least a first button configured to wirelessly control a first device. The backside can comprise a battery access opening configured to enable replacing the first battery. As well, the remote control system can include a second battery cover that can block the battery access opening. The second battery cover can include a second remote control having a second battery configured to provide a second electrical power to the second remote control. The second remote control can be configured to wirelessly control a second device.

10 Claims, 16 Drawing Sheets

(56) References Cited

U.S. PATENT DOCUMENTS

| | | | | |
|---|---|---|---|---|
| 2010/0151304 | A1* | 6/2010 | Dong | E05C 19/06 429/97 |
| 2010/0310914 | A1 | 12/2010 | Maier | |
| 2012/0140117 | A1* | 6/2012 | Waites | G08C 17/02 348/563 |
| 2012/0273375 | A1 | 11/2012 | Rice | |

OTHER PUBLICATIONS

Sideclick for Roku—Website Downloaded on Jun. 8, 2015 from www.sideclickremotes.com/#!roku/c1f8w.
Sideclick for Amazon Fire TV—Website Downloaded on Jun. 8, 2015 from www.sideclickremotes.com/#!amazon-fire-tv/c1rgl.
Sideclick for Amazon Fire TV Stick—Website Downloaded on Jun. 8, 2015 from www.sideclickremotes.com/#!annazon-fire-tv-stick/c2lo.
Sideclick for Apple TV—Website Downloaded on Jun. 8, 2015 from www.sideclickremotes.com/#!apple-tv/c1jdi.

* cited by examiner

REMOTE CONTROL SYSTEMS AND METHODS

CROSS-REFERENCE TO RELATED APPLICATIONS

This application claims the benefit of U.S. Provisional Patent Application No. 62/144,286; filed Apr. 7, 2015; and entitled REMOTE CONTROL SYSTEMS AND METHODS. The entire contents of Patent Application No. 62/144,286 are incorporated by reference herein.

BACKGROUND

Field

Various embodiments disclosed herein relate to remote controls. Certain embodiments relate to remote controls for electronic devices, such as streaming media players, televisions, and the like.

Description of Related Art

Streaming media players are home entertainment electronic devices that can connect to wi-fi networks to stream digital media content to televisions. During use, streaming media players and televisions can be wirelessly controlled by remote control devices.

A drawback of conventional streaming media players and televisions is that they often require separate remote control devices. Users of these devices can often find it inconvenient to use separate remote control devices to control their respective streaming media players and televisions. Thus, there appears to be a need for devices and methods to eliminate the need to use separate remote control devices.

SUMMARY

This disclosure includes a remote control system comprising a first remote control having a front side, a backside, and a first battery configured to provide a first electrical power to the first remote control, wherein the front side comprises at least a first button configured to wirelessly control a first device, wherein the backside comprises a battery access opening configured to enable replacing the first battery; and a second battery cover that blocks the battery access opening, wherein the second battery cover comprises a second remote control having a second battery configured to provide a second electrical power to the second remote control, wherein the second remote control is configured to wirelessly control a second device.

In embodiments, the second remote control comprises at least a second button configured to wirelessly control the second device, wherein the second remote control is integrated into the second battery cover such that the second button is located on the backside while the first button of the first remote control is located on the front side.

Furthermore, in embodiments, the second remote control is mechanically coupled to the first remote control but is not electrically coupled to the first remote control, the second remote control being electrically independent of the first remote control. In some embodiments, the first battery is located at least partially between the first remote control and the second remote control. In some embodiments, the first battery and the second battery are located at least partially between the first remote control and the second remote control. In some embodiments, the first remote control and the second battery cover form an outer housing that surrounds at least a majority of the second remote control. In some embodiments, the first remote control comprises a radio remote control, the first device comprises a streaming media player, the second remote control comprises an infrared remote control, and the second device comprises a television.

Even still, in embodiments, the first remote control comprises a Bluetooth remote control, and the second remote control comprises an infrared remote control.

In embodiments, the second battery cover protrudes away from the front side such that the backside is thickest in a region of the remote control system that includes the second battery cover, wherein the second battery cover comprises an infrared light oriented forward to emit light along a portion of the backside that does not include the second battery cover.

Furthermore, in embodiments, the first remote control is configured such that a first battery cover that does not comprise a remote control capability is removed from the first remote control and then replaced by the second battery cover to enable the remote control system to wirelessly control the first device and the second device, wherein the first battery cover comprises a second protrusion having a second profile configured to couple the first battery cover to the first remote control, and wherein the second remote control is mechanically coupled to the first remote control by a first protrusion having a first profile that matches the second profile of the second protrusion of the first battery cover.

Even still, in embodiments, the second remote control is mechanically coupled to the first remote control by a first protrusion and a second protrusion.

In embodiments, the second remote control comprises a first end and a second end, wherein the first end comprises a first protrusion that enters a first indentation in the first remote control to couple the second remote control to the first remote control, and wherein the second end comprises a second protrusion that enters a second indentation in the first remote control to couple the second remote control to the first remote control.

Furthermore, in embodiments, the second remote control comprises a first half and a second half, wherein the first half comprises a first protrusion that enters a first indentation in the first remote control to couple the second remote control to the first remote control, and wherein the second half comprises a second protrusion that enters a second indentation in the first remote control to couple the second remote control to the first remote control.

Even still, in embodiments, the second battery cover comprises an outer housing that surrounds at least a majority of the second remote control, the second remote control comprising at least a second button configured to wirelessly control the second device, and the second button is located on the backside while the first button of the first remote control is located on the front side.

In embodiments, the first remote control comprises indentations configured to couple a first battery cover that does not comprise remote control capabilities to the first remote control, wherein the indentations mechanically couple the second remote control to the first remote control, and wherein the second battery cover comprises a light emitting diode and a printed circuit board that are not electrically coupled to the first remote control.

The disclosure also includes a remote control battery cover, comprising an outer housing; at least one button located along the outer housing, wherein the at least one button is configurable to wirelessly control a television; and a protrusion that protrudes from the outer housing, wherein the protrusion is configurable to mechanically couple to a remote control.

In embodiments, the protrusion is a first protrusion that protrudes from an outer surface of the outer housing, and the first protrusion is configurable to mechanically couple to a first indentation of the remote control. In some embodiments, the remote control battery cover further comprises a second protrusion that protrudes from an inner surface of the outer housing, wherein the second protrusion is configurable to mechanically couple to a second indentation of the remote control; a printed circuit board located within the outer housing; and a light that is electrically coupled to the printed circuit board, wherein the light is configurable to emit pulses of infrared light to the television, wherein the remote control defines a front side having buttons and a backside that is opposite the front side, and wherein the remote control battery cover is configurable to mechanically couple to the backside of the remote control.

The disclosure also includes a remote control system comprising a remote control having a front side and a backside that is opposite the front side; a first plurality of buttons located along the front side of the remote control, wherein the first plurality of buttons are configurable to wirelessly control a first device; and a second plurality of buttons located along the backside of the remote control, wherein the second plurality of buttons are configurable to wirelessly control a second device.

The disclosure also includes a method of replacing a first battery cover of a first remote control that is configured to wirelessly control a media player. In embodiments, the method comprises removing the first battery cover of the first remote control; and replacing the first battery cover with a second battery cover, wherein the second battery cover comprises a second remote control configured to wirelessly control a television.

In embodiments, the method further comprises coupling the second remote control to the first remote control by coupling the second remote control to indentations that were previously used to attach the first battery cover to the first remote control.

Furthermore, in embodiments, the method further comprises electrically coupling a second battery to the second remote control such that the second remote control is mechanically coupled to the first remote control but is not electrically coupled to the first remote control, the second remote control being electrically independent of the first remote control.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Introduction

Streaming media players are network appliances and entertainment devices that can receive digital data from a number of sources and stream it to a television (TV), whereby the television plays it on the television screen. Streaming media players are increasingly becoming the device of choice for viewing cloud based media content. Example streaming media players include Apple TV (made by Apple Inc.), Fire TV (made by Amazon.com Inc.), and Roku 3 (made by Roku Inc.).

Media Player Remote Control Embodiments

Figure 1:
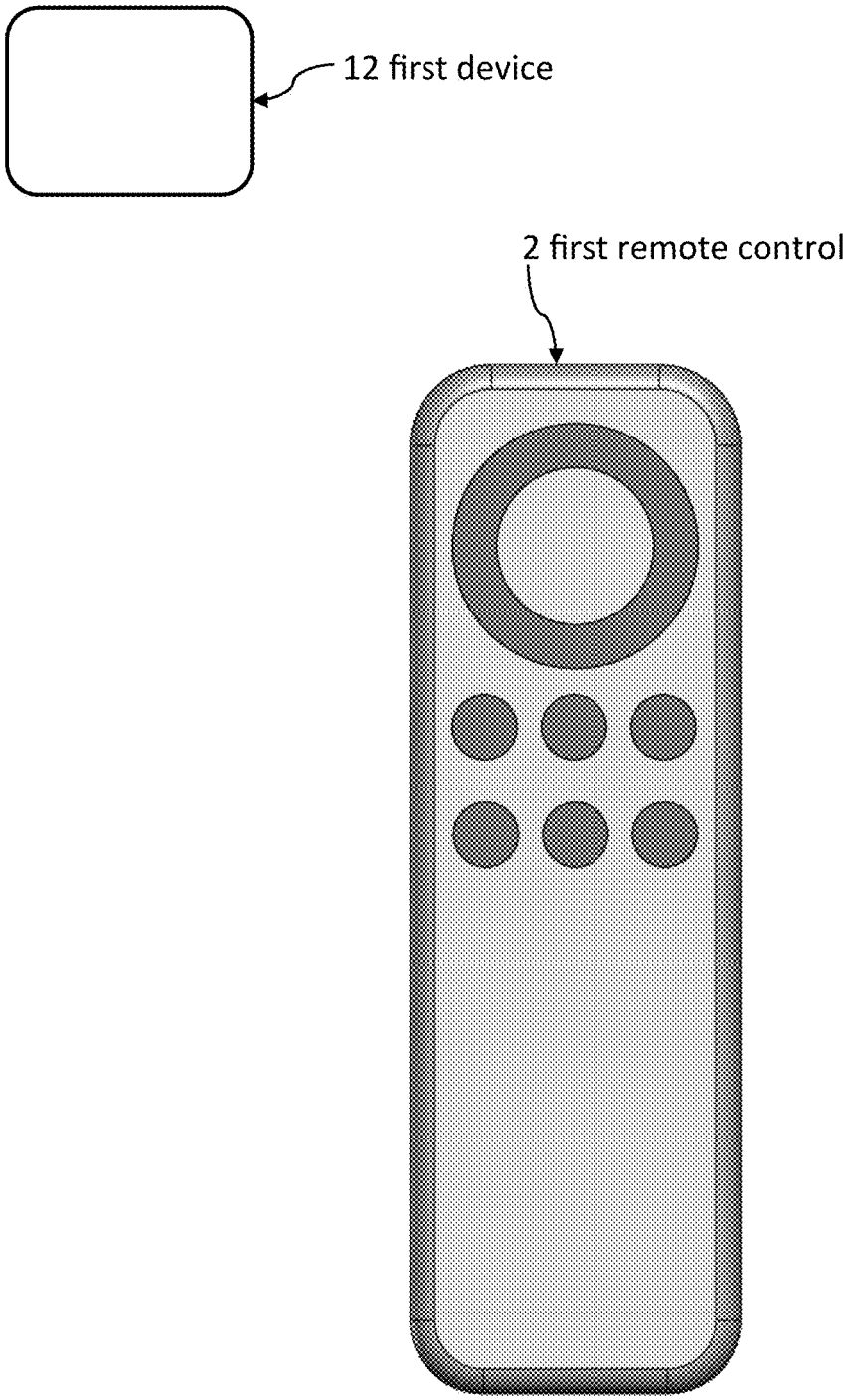
FIG. 1 illustrates a first device and a front view of a first remote control, according to some embodiments.

As illustrated in FIG. 1, most streaming media players include a dedicated remote control, such as a first remote control 2, for controlling and navigating the user interface of the streaming media player, such as a first device 12. Accordingly, the first remote control 2 can be communicatively coupled to the first device 12, whereby the first remote control 2 can be configured to wirelessly control the streaming media player. While the first device 12 may refer to streaming media players throughout much of this disclosure, the first device 12 is not limited to streaming media players. In various embodiments, the first device 12 can include DVD players, game consoles, stereo receivers, computers (e.g. laptops and desktops), remote computing devices (e.g. smart phones, tablets, etc.), and the like.

The first remote control 2 can employ new communication interfaces, such as Bluetooth communication and/or radio frequency communication, between the first remote control 2 and the first device 12 (e.g. the streaming media player) rather than the legacy communication interfaces, such as infrared wave (IR) communication. The new communication interfaces can have the advantages of being longer range and not limited to line-of-sight operation. The television can also include a remote control configured to wirelessly control the television. Oftentimes, the television utilizes a remote control device that employs one of the legacy communication interfaces.

A drawback of media player remote controls, such as Bluetooth remotes, is that they are oftentimes incompatible with IR based remotes used for televisions. It might therefore not be possible to control the television with the Bluetooth based streaming media player remote. The requirement to use two separate remotes to fully control the entertainment experience may not be desirable for many end users. Thus, there appears to be a need to integrate an IR television remote into the existing streaming media player Bluetooth remote.

Many approaches can be employed to integrate IR into a Bluetooth remote. For example, the streaming media player OEM that develops the Bluetooth remote could, in theory, integrate an IR transceiver into the Bluetooth remote. The IR portion of the remote could be designed to have a learn function to determine the IR codes of the existing television remote and then replicate the television's IR signals. However, this approach has drawbacks, mainly in that adding IR functionality adds cost and size to every Bluetooth remote manufactured by the OEM. As well, some end users may not value the IR integration.

Figure 2:
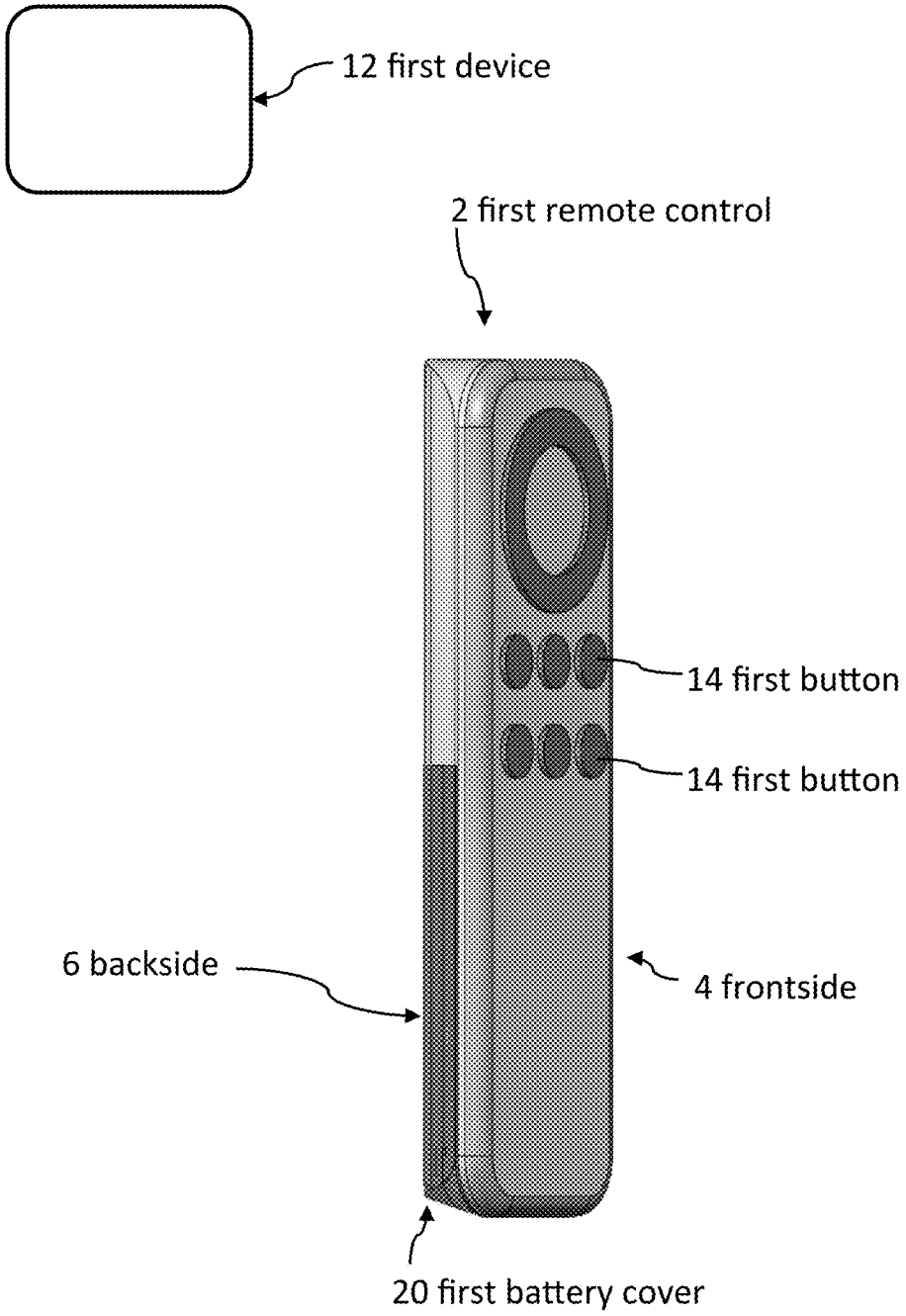
FIG. 2 illustrates a first device and a perspective view of a first remote control, according to some embodiments.

Referring now to FIG. 2, a first remote control 2 can include a front side 4, a backside 6 that is substantially opposite the front side 4, and first buttons 14 configured to wirelessly control a first device 12 (e.g., a streaming media player).

Figure 3:
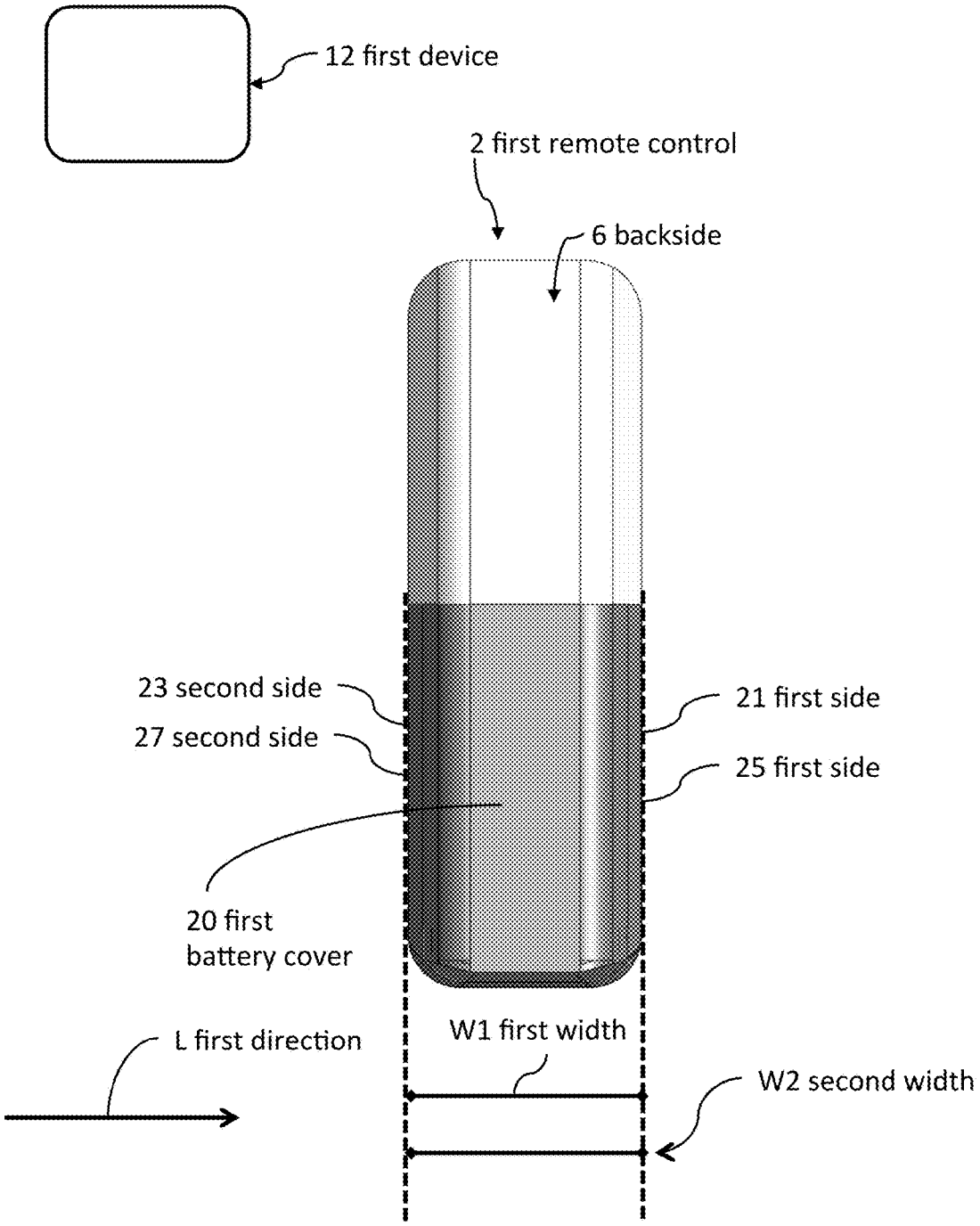
FIG. 3 illustrates a first device and a back view of a first remote control, according to some embodiments.
Figure 4:
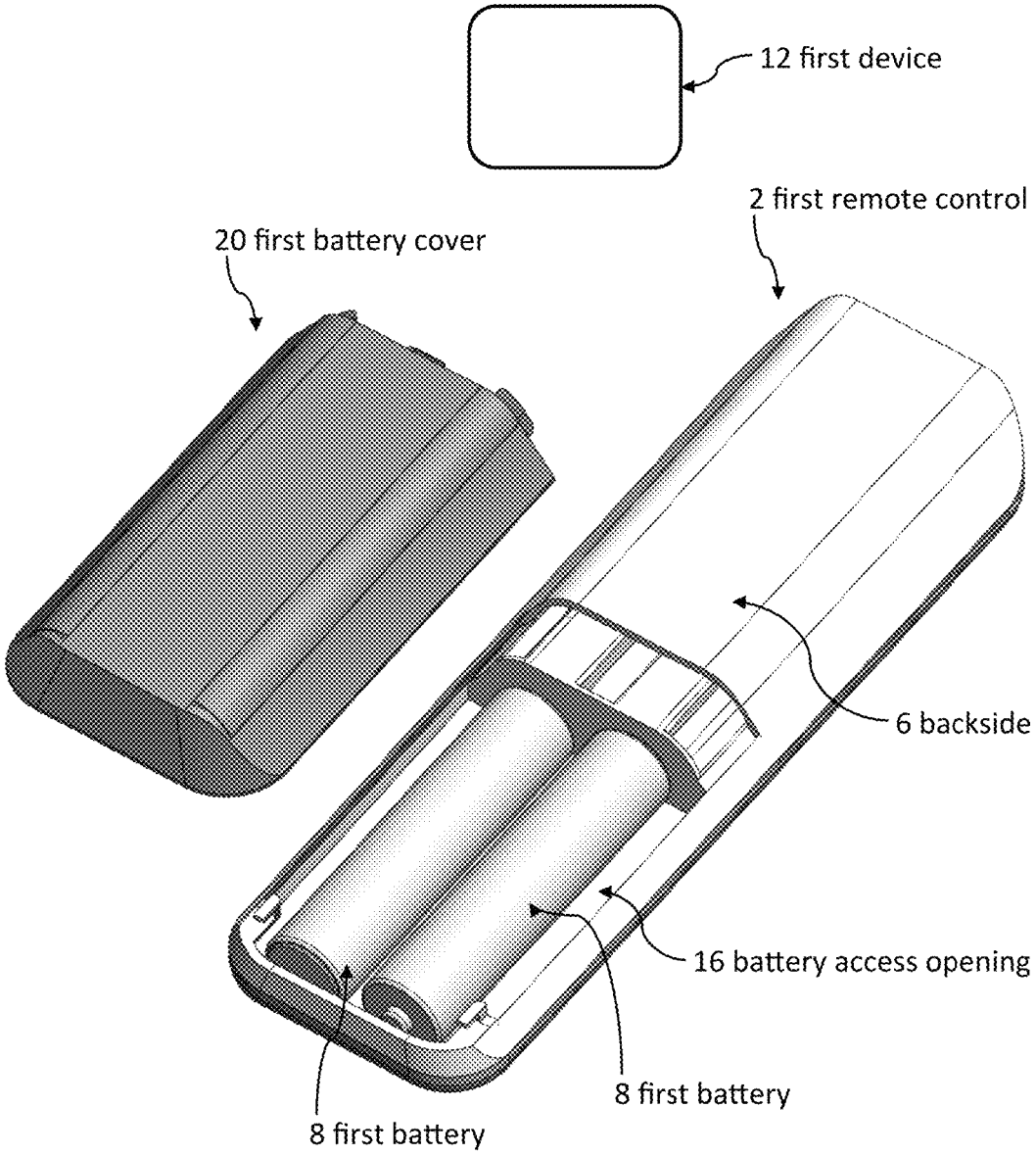
FIG. 4 illustrates a first device and a back view of a first remote control with a first battery cover detached, according to some embodiments.

As shown in FIGS. 3 and 4, the backside 6 of the first remote control 2 can comprise a first battery cover 20 that can be removed to reveal a first battery 8. The first battery 8 can comprise a replaceable AA/AAA battery, a coin cell battery, and the like, which can be configured to provide first electrical power to the first remote control 2. Furthermore, the first battery 8 can be housed within a battery access opening 16, which can be configured to enable removal and retention of the first battery 8. Accordingly, the first battery cover 20 can couple to the backside 6 of the first remote control 2, whereby the first battery cover 20 covers the battery access opening 16 to first battery 8.

With specific reference to FIG. 3, the first battery cover 20 can define a first width W1 that extends along a first direction L. The first width W1 can extend from a first side 21 of the first battery cover 20 to a second side 23 of the first battery cover 20, whereby the second side 23 is disposed opposite the first side 21. As well, the first remote control 2 can define a second width W2 that also extends along the first direction L. The second width W2 can extend from a first side 25 of the first remote control 2 to a second side 27 of the first remote control 2, whereby the second side 27 is disposed opposite the first side 25. In some embodiments, the first width W1 is substantially equal to the second width W2. This can provide an aesthetically appealing appearance that can also provide a comfortable surface for the user to grip during use.

Add-on Remote Control Embodiments

In order to resolve the incompatibilities between the streaming media player remote and the IR remote, embodiments of the invention can include an "add-on" IR remote control module that can be integrated into an existing streaming media player remote as an after market device. The add-on remote could be coupled to the Bluetooth remote via various attachment means, such as an adhesive, a mechanical clamp, and the like. An "add-on" IR remote module can be configured to easily and securely attach to the existing streaming media player remote. Additionally, the "add-on" IR remote module can be detachable because some end users may not wish to permanently alter their Bluetooth remote with an IR remote control module. As previously mentioned, this invention can also be applicable to areas outside of streaming media players. Examples can include, but are not limited to DVD player remotes, game consoles (e.g. integrate an IR remote into an XBOX game controller), stereo receiver remotes, computer remotes (e.g. laptops and desktops), remote computing devices (e.g. smart phones, tablets, etc.), and the like.

Figure 5:
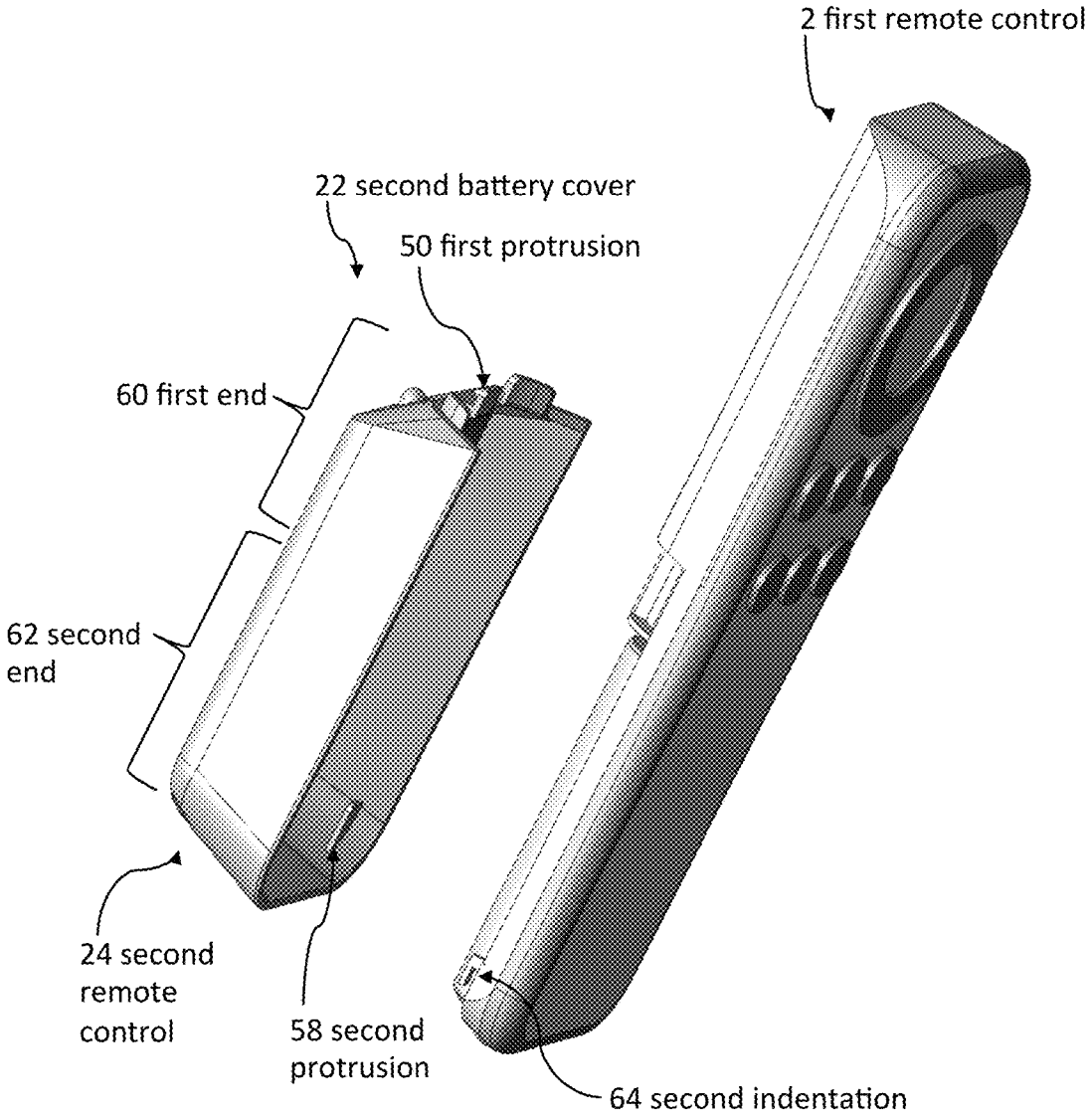
FIG. 5 illustrates a perspective view of a first remote control and a second remote control, according to some embodiments.
Figure 6:
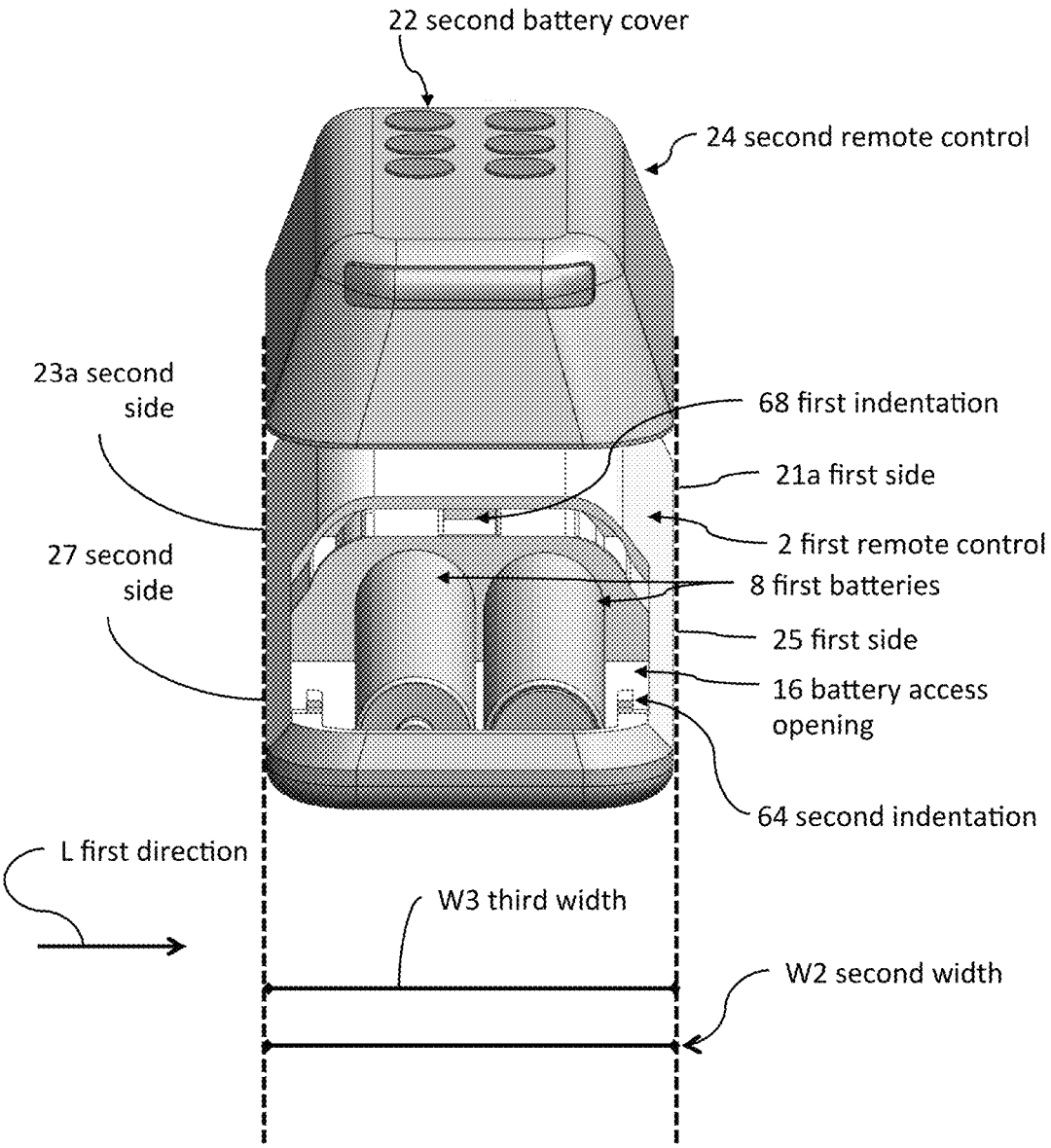
FIG. 6 illustrates a bottom end view of a first remote control and a second remote control, according to some embodiments.

Embodiments of the add-on remote can include a secondary remote that attaches to a primary remote, such as the first remote control 2, to extend communication capability (adds IR functionality). For example, as illustrated in FIGS. 5 and 6, embodiments of the add-on remote, or piggyback remote can include a second battery cover 22 that securely attaches to the backside 6 of the first remote control 2. In this manner, the end user could remove the first battery cover 20 and replace it with the second battery cover 22.

The second battery cover 22 can comprise a second remote control 24 that can be configured to wirelessly control a second device 30 (e.g., a television). Therefore, by attaching the second battery cover 22 (which includes the second remote control 24) to the backside 6 of the first remote control 2, the second battery cover 22 and the second remote control 24 can serve both as a battery cover and an IR remote for the television, or any other such device to which the second remote control 24 is communicatively coupled. It should be appreciated that because the second remote control 24 can be attached to the backside 6 of the first remote control 2, the second remote control 24 can be referred to as a "Piggyback Remote."

Now referring to FIGS. 5 and 6, the second remote control 24, via the second battery cover 22, can be mechanically coupled to the backside 6 of the first remote control 2. Accordingly, the first remote control 2 and the second remote control 24 can include various mechanical features to allow the first and second remote controls 2 and 24 to be mechanically coupled together. For example, the first remote control 2 can include at least one first indentation 68 and at least one second indentation 64. Accordingly, the first and second indentations 68 and 64 can thereby mechanically couple the second remote control 24 to the first remote control 2.

In some embodiments, the second remote control 24 can include at least one first protrusion 50 that protrudes from a first end 60 of the second remote control 24. For example, as shown in FIG. 5, the first protrusion 50 can protrude from an outer surface of the second remote control 24. The first protrusion 50 can be configured to mechanically couple to the first indentation 68 of the first remote control 2.

With continued reference to FIGS. 5 and 6, the second remote control 24 can also include at least one second protrusion 58. In some embodiments, the second protrusion 58 can protrude from a second end 62 that is opposite the first end 60 of the first protrusion 50. As well, as shown in FIG. 5, the second protrusion 58 can protrude from an inner surface of the second remote control 24. As well, the second protrusion 58 can be configured to mechanically couple to the second indentation 64 of the first remote control 2.

The first protrusion 50 and the second protrusion 58 can be configured such that they substantially match the size and shape of the corresponding protrusions on the first battery cover 20. Accordingly, this feature can thereby provide for secure mechanical coupling between the first remote control 2 and the second remote control 24.

Figure 7:
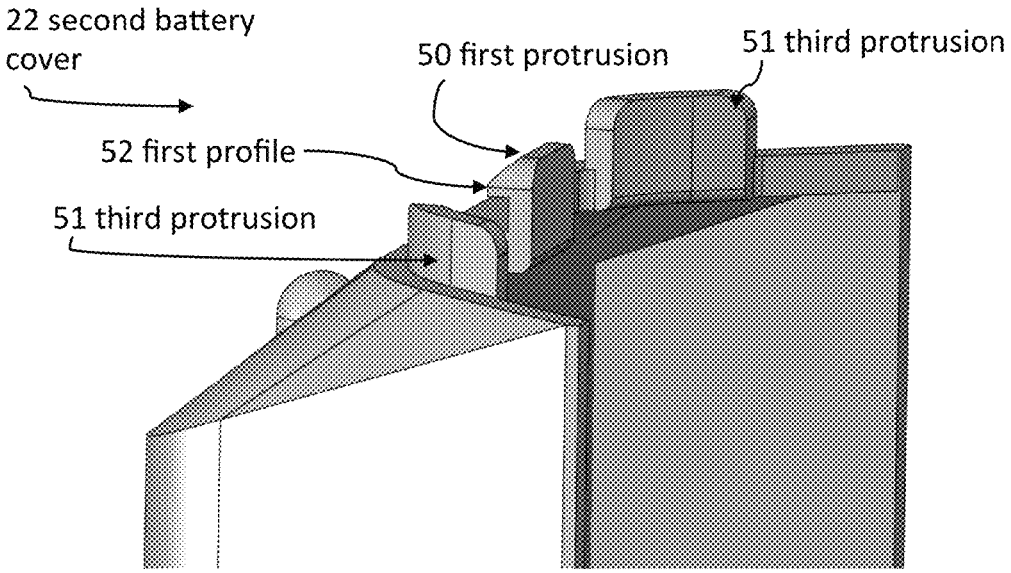
FIG. 7 illustrates a perspective view of a second battery cover, according to some embodiments.

As illustrated in FIG. 7, the second battery cover 22 can be configured to comprise any number and style of protrusions that assist in mechanically coupling the second battery cover 22 to the first remote control 2. For example, the first protrusion 50 can define any shape to assist in mechanical coupling to the first remote control 2. In some embodiments, as shown in FIG. 7, the first protrusion 50 includes a first profile 52 that can define a mechanical latch. In this manner, the first profile 52 can mechanically latch (or couple) to a corresponding feature of the first remote control 2. Furthermore, the first profile 52 may be configured to make a "click" noise when the first profile 52 is engaged to the corresponding feature of the first remote control 2. This may provide feedback to the user that the second battery cover 22 is thereby mechanically coupled to the first remote control 2.

In addition to the first protrusion 50, some embodiments of the second battery cover 22 may include one or more third protrusions 51. The third protrusion 51 may be configured with or without a profile, similar to the first profile 52. The third protrusion 51 may include a profile to provide reinforced security in mechanically coupling the second battery cover 22 to the first remote control 2. However, the third protrusion 51 may not include a profile, and may thereby act as a guide to align the second battery cover 22 to the first remote control 2 during mechanical coupling.

Figure 8:
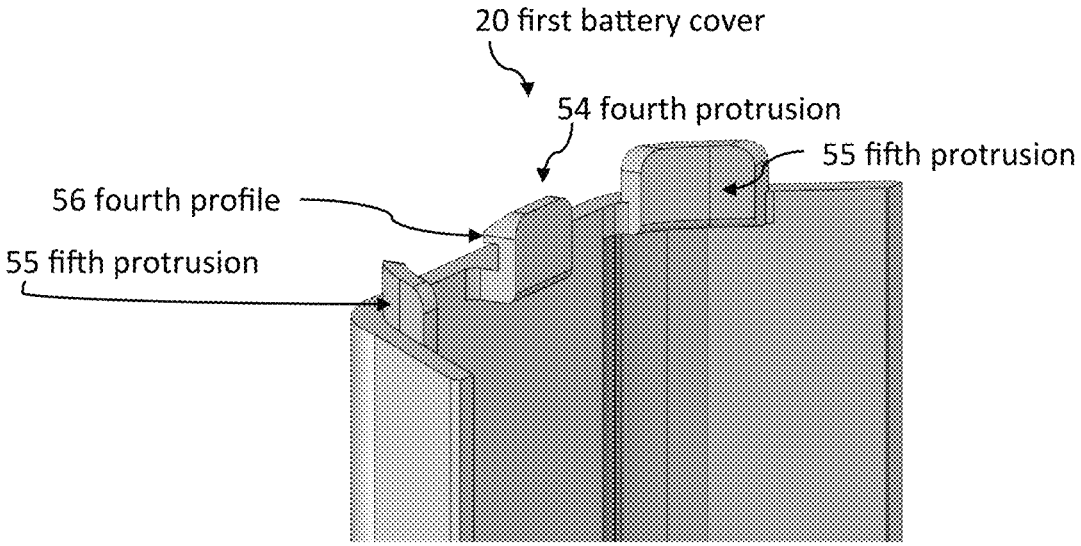
FIG. 8 illustrates a perspective view of a first battery cover, according to some embodiments.

The protrusion(s) of the second battery cover 22, such as the first protrusion 50, first profile 52, and third protrusion 51 (if any), may be configured to substantially match any of the size, shape, material, and mechanical features of the first battery cover 20. For example, as illustrated in FIGS. 7 and 8, the first protrusion 50 may be configured to match a fourth protrusion 54 of the first battery cover 20, while the first profile 52 may be configured to match a fourth profile 52 of the first battery cover 20. As well, the third protrusion 51 may be configured to match a fifth protrusion 55 of the first battery cover 20.

By substantially matching the protrusions of the second battery cover 22 with the protrusions of the first battery cover 20, this may allow the user to install the second battery cover 22 as if it were an original equipment manufacturer (OEM) part made by the manufacturer of the first remote control 2. In this regard, the second battery cover 22 can be custom configured to specifically match one or more first remote controls 2 as made by a manufacturer. Accordingly, by matching protrusions between the first and second battery covers this may remove the guesswork to determine if the second battery cover 22 will work with a specific first remote control 2. As well, when the second battery cover 22 is mechanically coupled to the first remote control 2, it may also produce a finished look that appears as if the second battery cover 22 was designed specifically for the first remote control 2, and not some universal aftermarket accessory that fits any remote control.

Furthermore, when the first remote control 2 is coupled to the second remote control 24, the first protrusion 50, second protrusion 58, first indentation 68, and second indentation 64 can thereby be hidden within an internal space of the second remote control 24 so they may not be outwardly visible to the user. This feature can allow for seamless coupling and improved aesthetics as compared to other add-on remote solutions.

While the second remote control 24 can be mechanically coupled to the first remote control 2, the second remote control 24 can be electrically independent of the first remote control 2. In this manner, the second remote control 24 can be coupled to a second battery 26 that can provide a second electrical power (or second electricity) to the second remote control 24. In some embodiments, the first battery 8 and the second battery 26 are electrically disconnected, such that the first and second remote controls 2 and 24 are electrically decoupled and thereby electrically independent. In this manner, the first remote control 2 and the second remote control 24 can be said to have independent and separate power sources. Furthermore, once the second battery cover 22 is coupled to the backside 6 of the first remote control 2, the first battery 8 can be located at least partially between the first remote control 2 and the second remote control 24. In some embodiments, the first battery 8 can be located within both an internal portion of the first remote control 2 and an internal portion of the second remote control 24.

In some embodiments, the second remote control 24 can be electrically coupled to the first remote control 2. Specifically, in some embodiments, the second remote control 24 can be electrically coupled to the same power source as the first remote control 2, such as the first battery 8. Even still, in some embodiments, the second remote control 24 can include its own power source, such as the second battery 26. However, the second battery 26 can be electrically coupled to the first battery 8 to thereby create an electrical couple between the first and second remote controls 2 and 24.

Surfaces of the second remote control 24 may be configured to substantially align with various mating surfaces of the first remote control 2 to thereby produce an aesthetically appealing appearance. For example, with specific reference to FIG. 6, the second remote control 24 can define a third width W3 that extends along a first direction L. Similar to the first width W1, as shown in FIG. 3, the third width W1 can extend from a first side 21*a* of the second battery cover 22 to a second side 23*a* of the second battery cover 22, whereby the second side 23*a* is disposed opposite the first side 21*a*. As well, the first remote control 2 can define a second width W2 that also extends along the first direction L. The second width W2 can extend from a first side 25 of the first remote control 2 to a second side 27 of the first remote control 2, whereby the second side 27 is disposed opposite the first side 25. In some embodiments, the first width W1 is substantially equal to the second width W2. Accordingly, matching the size of the third width W3 to the second width W2 can not only provide an aesthetically appealing appearance, but can also provide a comfortable surface for the user to grip during use.

Figure 9:
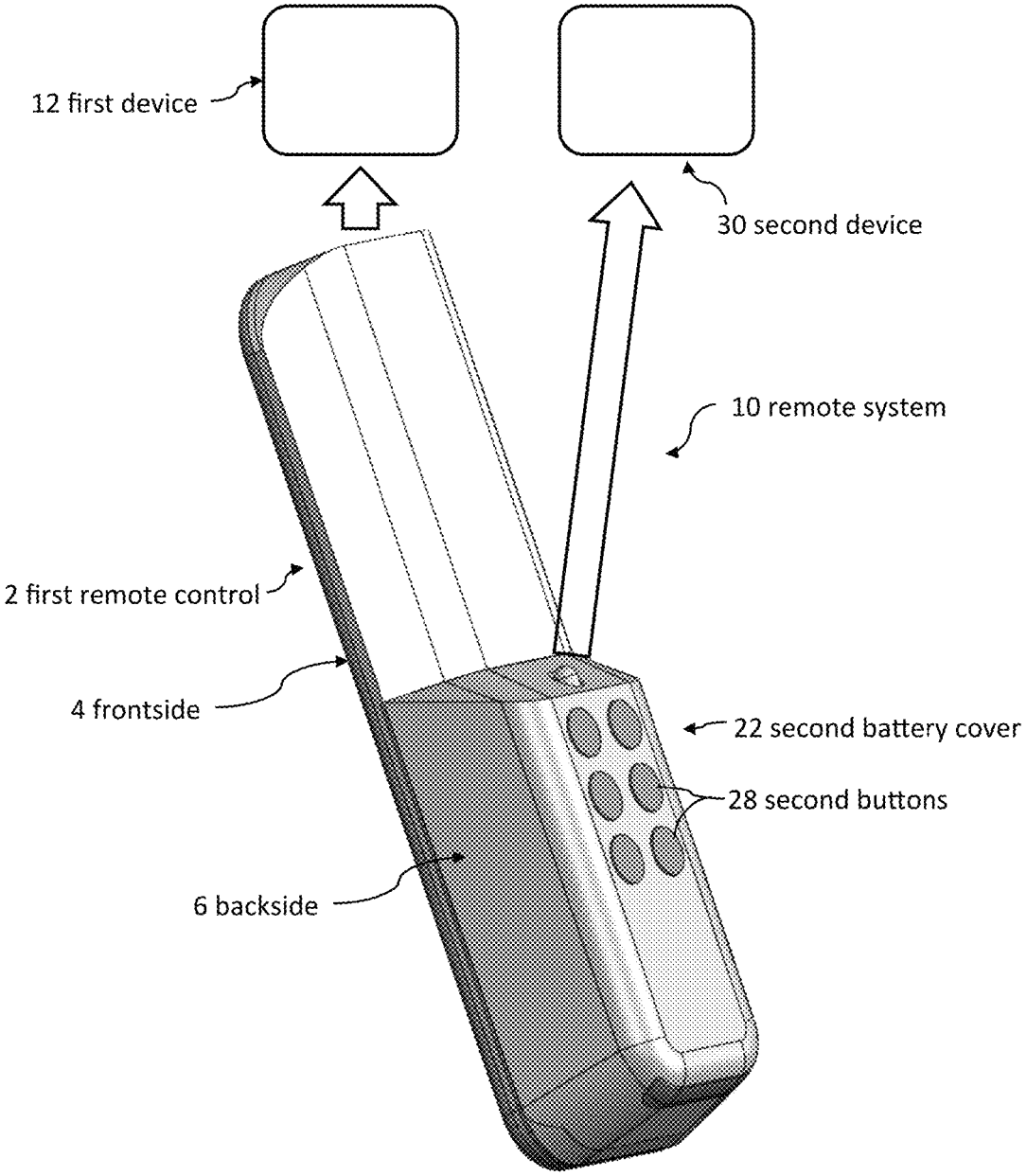
FIG. 9 illustrates a first device, a second device and a perspective view of a remote control system, according to some embodiments.
Figure 10:
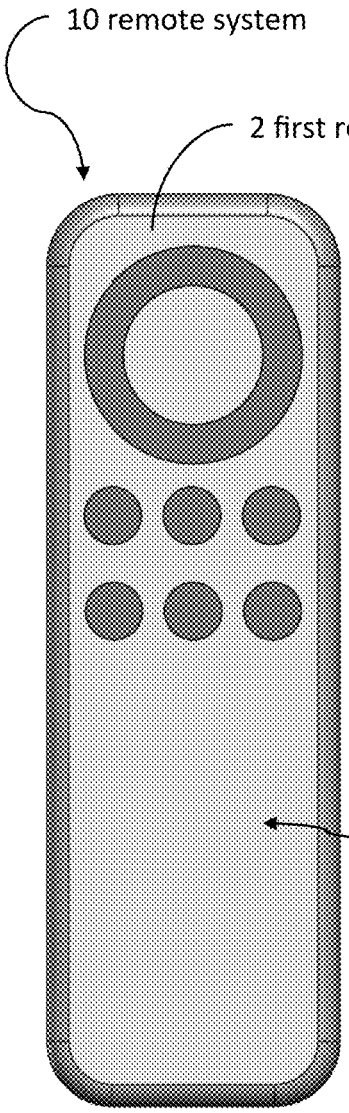
FIG. 10 illustrates a front view of a remote control system, according to some embodiments.
Figure 11:
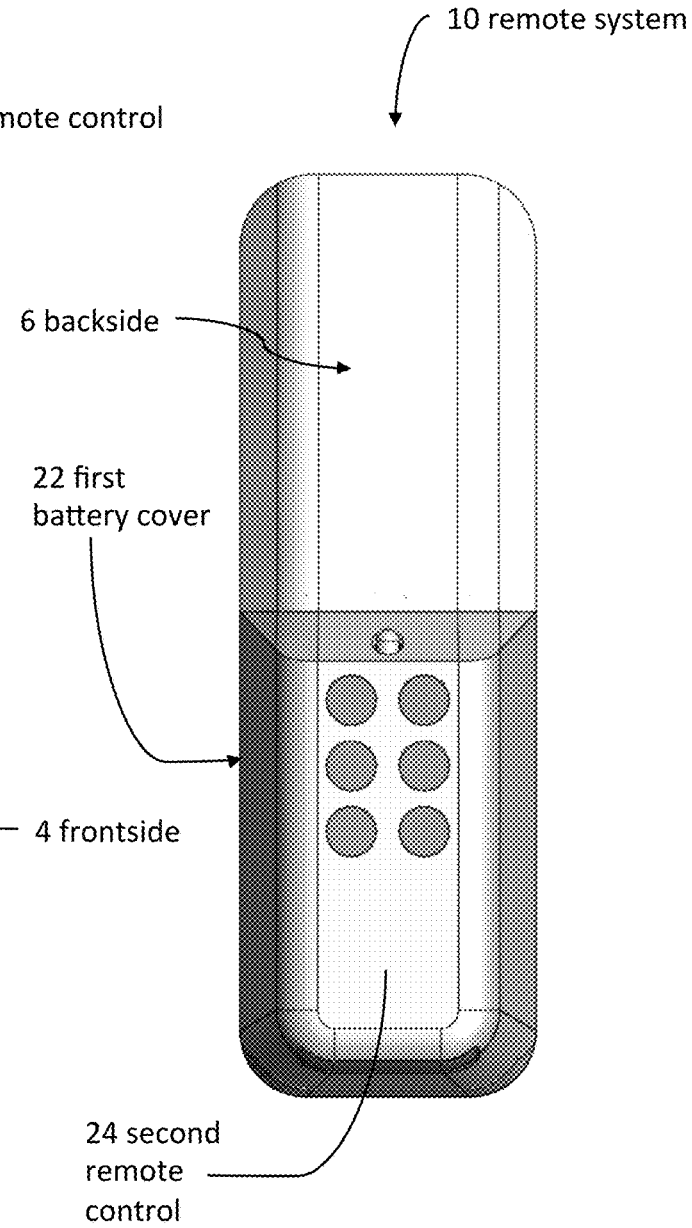
FIG. 11 illustrates a back view of a remote control system, according to some embodiments.
Figure 12:
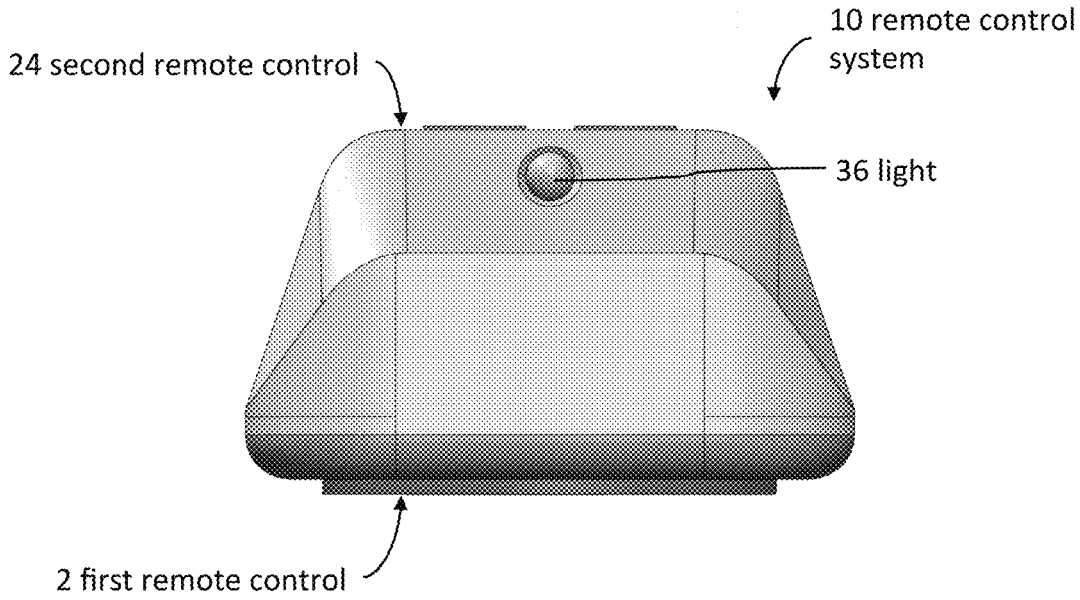
FIG. 12 illustrates a top view of a remote control system, according to some embodiments.
Figure 13:
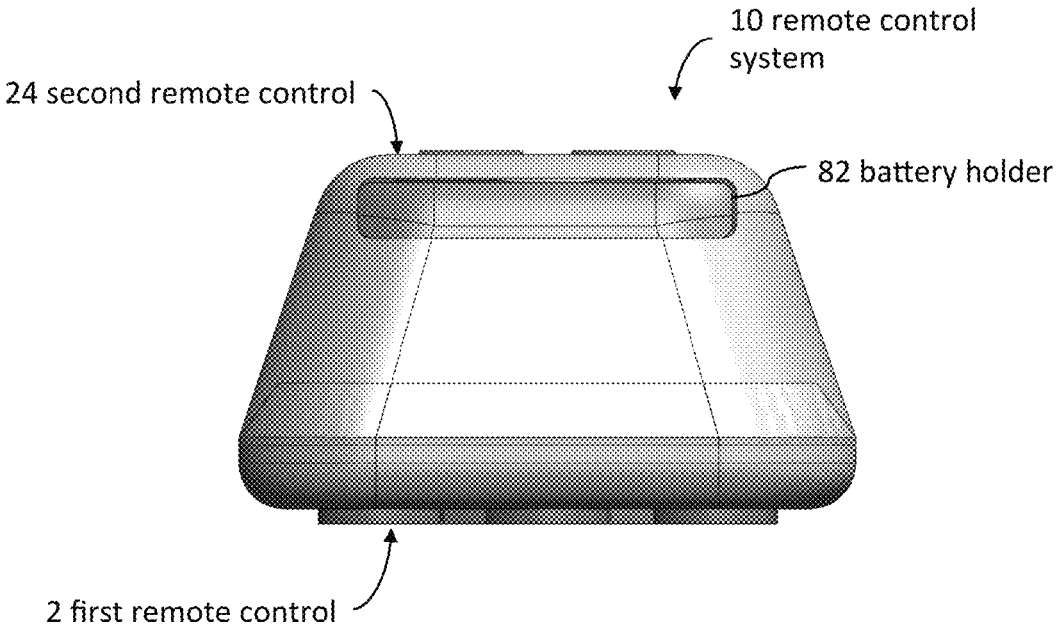
FIG. 13 illustrates a bottom view of a remote control system, according to some embodiments.

Referring now to FIG. 9, the second remote control 24 can comprise second buttons 28 configured to wirelessly control the second device 30. As further shown in FIGS. 9-13, the second remote control 24 can be integrated into the second battery cover 22 such that the second buttons 28 are located on the backside 6 while the first buttons 14 of the first remote control 2 are located on the front side 4. As such, the front side 4 can be communicatively coupled to the first device 12, while the backside 6 can be communicatively coupled to the second device 30. Stated differently, when the second remote control 24 is coupled to the first remote control 2, the front side 4 can thereby control the first device 12, while the backside 6 can control the second device 30.

Figure 14:
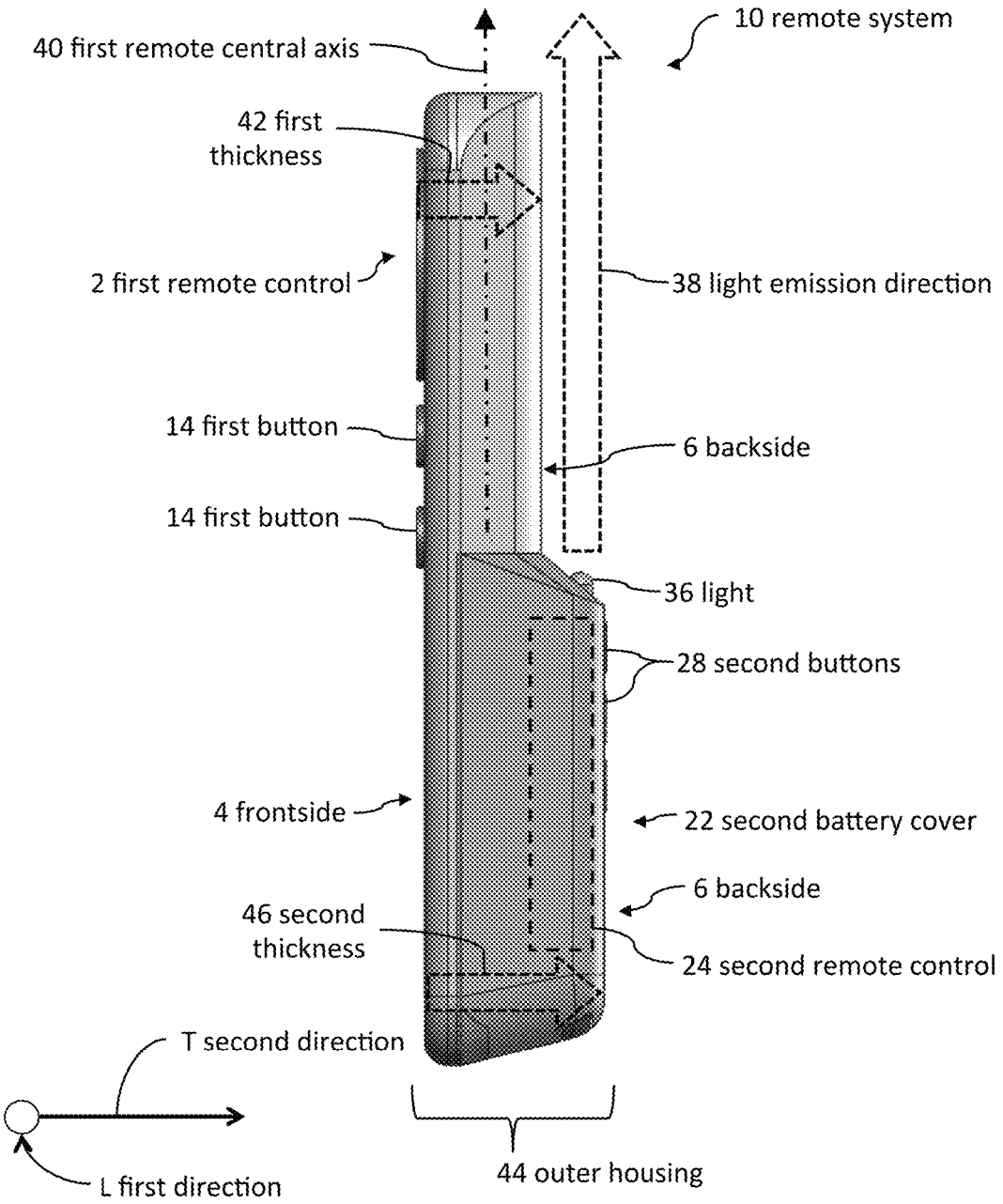
FIG. 14 illustrates a side view of a remote control system, according to some embodiments.
Figure 15:
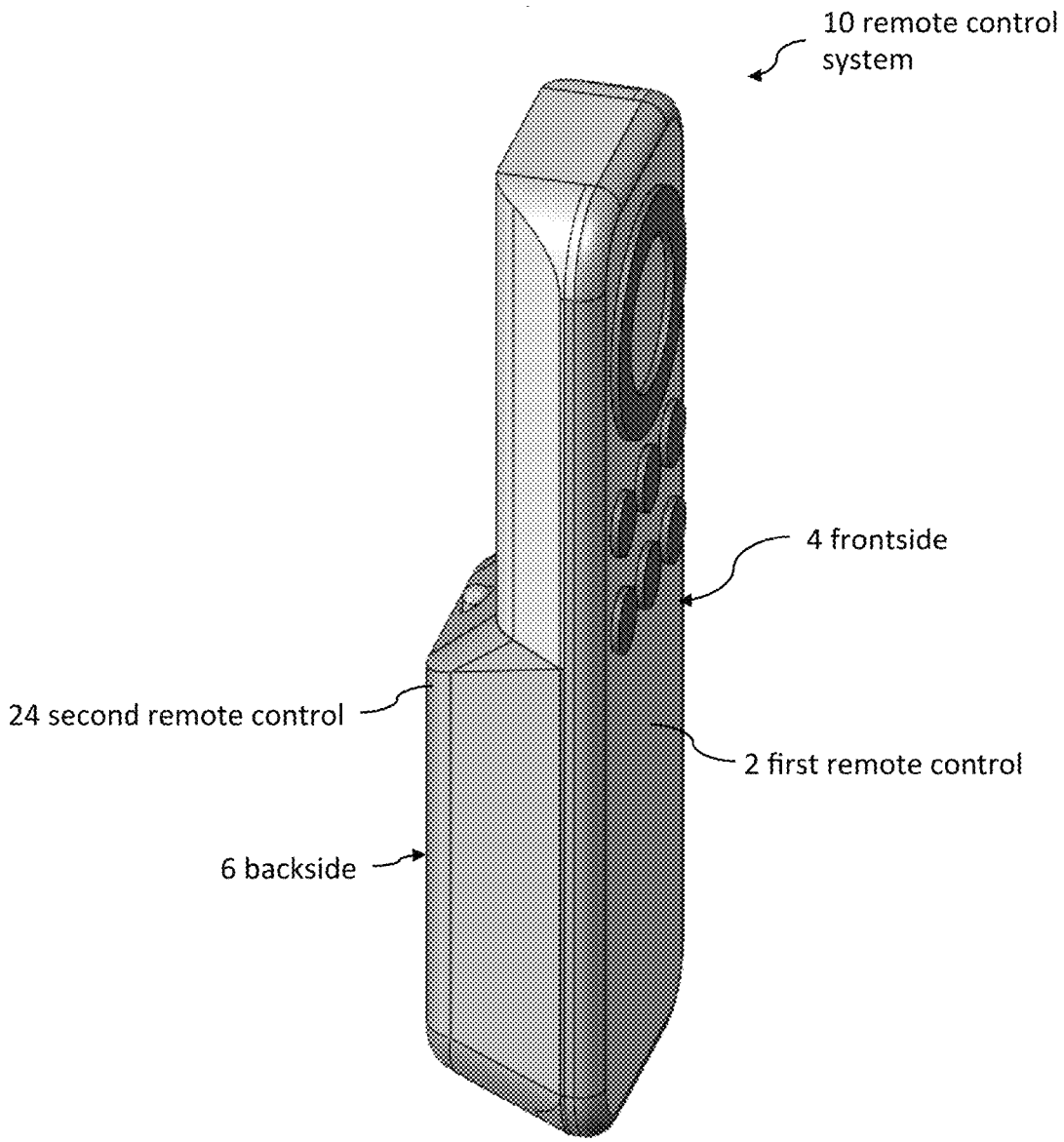
FIG. 15 illustrates a perspective view of a remote control system, according to some embodiments.
Figure 16:
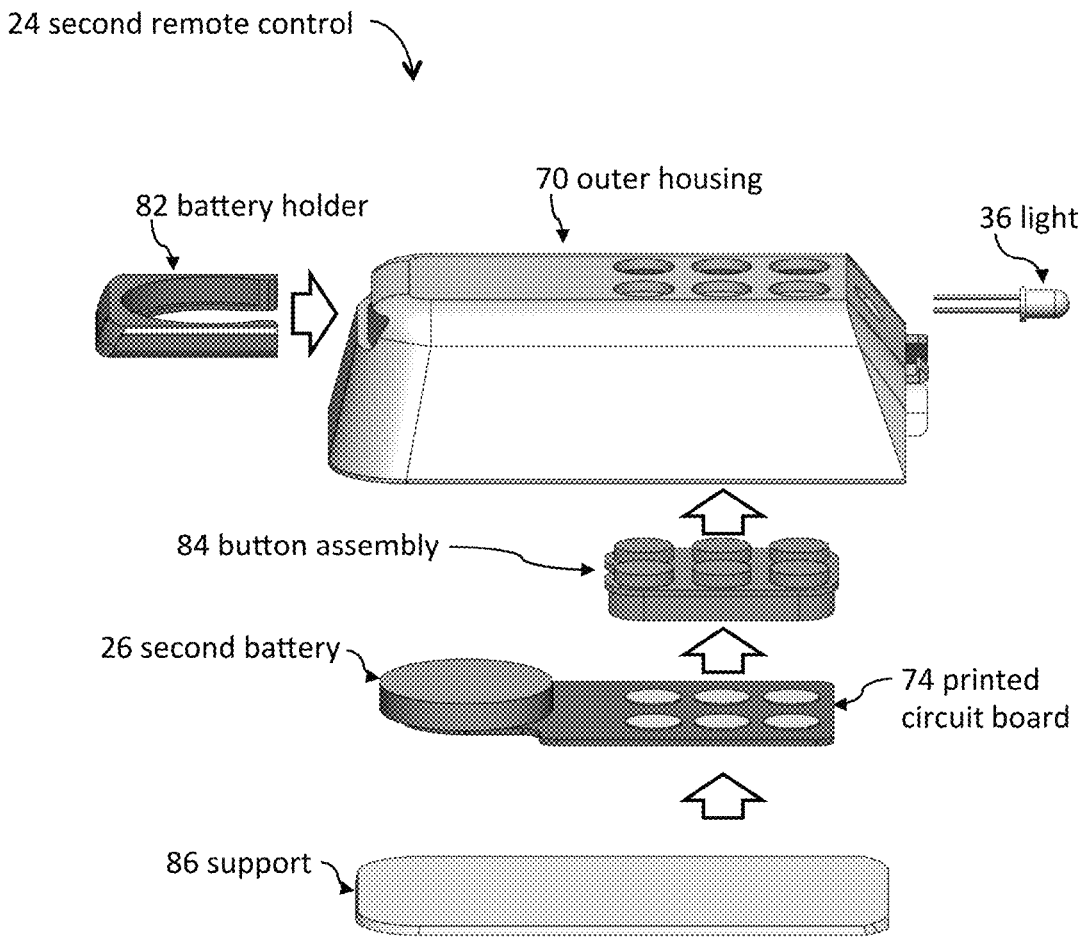
FIG. 16 illustrates an exploded view of a second remote control, according to some embodiments.
Figure 17:
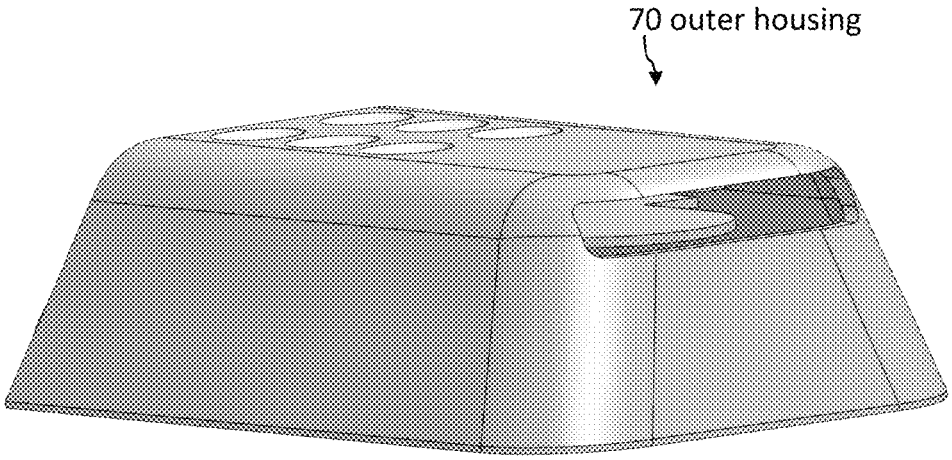
FIG. 17 illustrates a perspective view of an outer housing of a second remote control, according to some embodiments.
Figure 18:
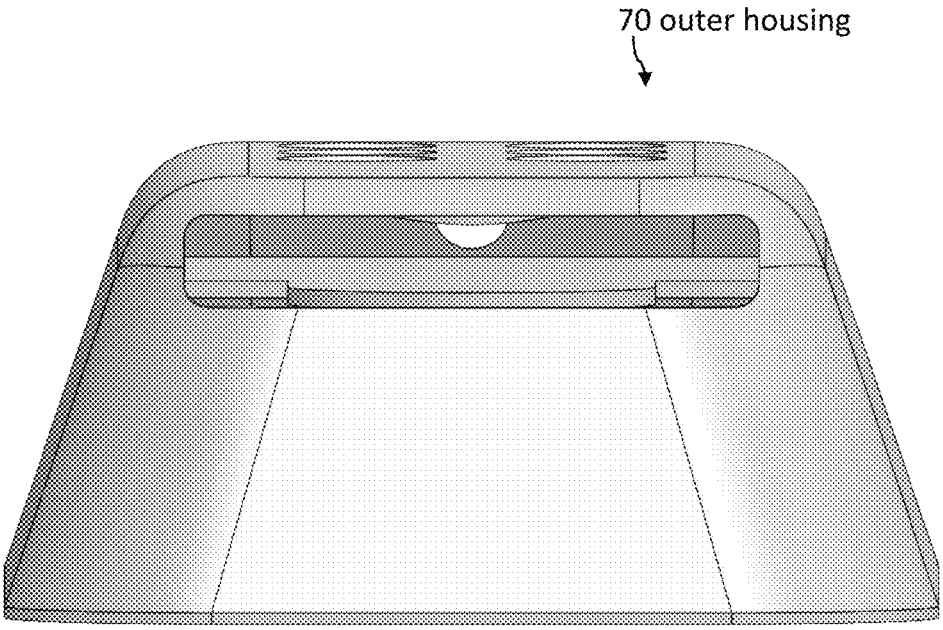
FIG. 18 illustrates a bottom view of an outer housing of a second remote control, according to some embodiments.

As illustrated in FIGS. 14 and 15, the remote control system 10 can comprise the first remote control 2 and the second remote control 24 as coupled to the backside 6 of the first remote control 2. As shown in FIG. 14, the remote control system 10 can define a first thickness 42 that extends along a second direction T at a first end of the remote control system 10, whereby the second direction T is perpendicular to the first direction L. As well, the remote control system 10 can define a second thickness 44 that extends along the second direction T at a second end of the remote control system 10. In some embodiments the first thickness 42 is less than the second thickness 46. However, in some embodiments, the first thickness 42 is greater than or equal to the second thickness 46.

The second remote control 24 can include a light 36, such as a light emitting diode (LED), which can send out pulses of infrared light along a light emission direction 38. The light 36 can be located anywhere along the second remote control 24 such that the light 36 has line of sight with the second device 30. As illustrated in FIG. 14, the light 36 can be located such that the light emission direction 38 travels adjacent along the backside 6 of the remote control system 10 for at least a portion of the distance until the pulses of infrared light reach the second device 30.

With reference to FIGS. 16-19, the second remote control 24 can comprise a plurality of components, including but not limited to an outer housing 70, a second battery 26, a light 36, a printed circuit board 74, a battery holder 82, a button assembly 84, and a support 86. The printed circuit board 74 may mechanically support and electrically connect (using conductive tracks, pads, and the like) the various electronic components such as the light 36, the second battery 26, and the button assembly 84.

Figure 19:
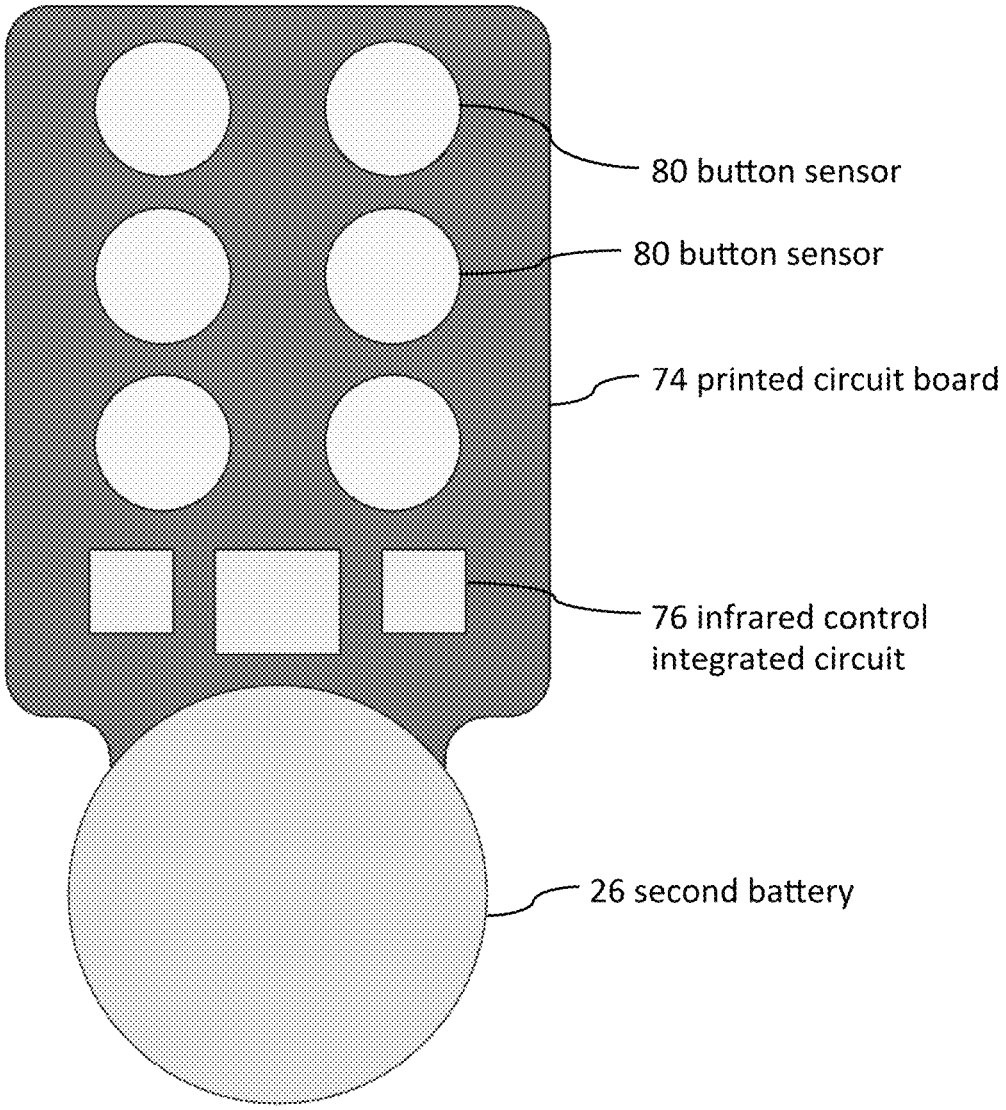
FIG. 19 illustrates a front view of a printed circuit board of a second remote control, according to some embodiments.

As shown in FIG. 19, the printed circuit board 74 may include at least one button sensor 80 and at least one infrared control integrated circuit 76, which may be electrically interconnected to the at least one button sensor 80. Specifically, the printed circuit board 74 may electrically interconnect any of the various components, such as the button assembly 84, the button sensor 80, the infrared control integrated circuit 76, the light 36, and the second battery 26. In this manner, the printed circuit board 74 may draw power from the second battery 26 to thereby power the various electronic components, such as the light 36. For example, when the user presses a button of the button assembly 84, this may initiate the light 36 to send a specific sequence of pulsed light, via the light 36, to thereby instruct the second device 30 to perform an action corresponding to the button press.

The various components of the second remote control 24 may be mechanically coupled to the outer housing 70 through a number of mechanical interconnections. For example, the second battery 26 may be mechanically coupled to the printed circuit board 74. As well, the second battery 26 may be mechanically retained by the battery holder 82, which may be slidably received by the outer housing 70. In this manner, the battery holder 82 may mechanically couple the printed circuit board 74, via the second battery 26, to the outer housing 70.

Furthermore, the button assembly 84 may be mechanically coupled to the printed circuit board 74. In this manner, buttons of the button assembly 84 may protrude through apertures of the outer housing 70 to snugly position the button assembly 84 and the printed circuit board 74 to the outer housing 70. As well, the printed circuit board 74 may be mechanically coupled to the support 86. In turn, the support 86 can be mechanically coupled to the outer housing 70, such as by a press fit or any other means of mechanically coupling.

The outer housing 70 may be dimensionally configured such that the stack of components, including the button assembly 84, second battery 26, battery holder 82, printed circuit board 74, and support 86, all fit within a first portion of the overall height of the outer housing 70. This may allow other components of the first remote control 2, such as the first battery 8, to thereby fit within a second portion of the overall height of the outer housing 70.

Figure 20:
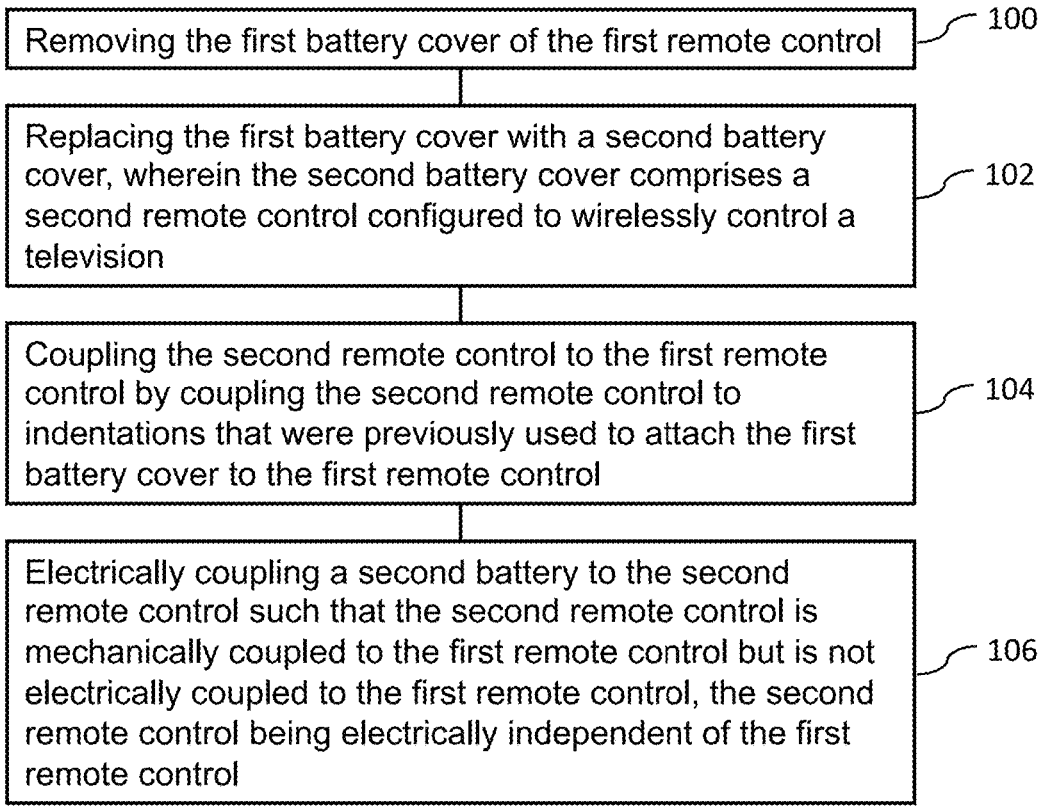
FIG. 20 illustrates a flow chart of a method of using a remote control system, according to some embodiments.

As illustrated in FIG. 20, this disclosure also includes various methods for removing the first battery cover 20 (at step 100) and replacing the first battery cover 20 with a second battery cover 22 (at step 102). Methods may include coupling the second remote control 24 to the first remote control 2 by coupling the second remote control 24 to indentations that were previously used to attach the first battery cover 20 to the first remote control 2 (at step 104). As well, methods may include electrically coupling a second battery 26 to the second remote control 24 such that the second remote control 24 may be mechanically coupled to the first remote control 2 but not electrically coupled to the first remote control 2 (at step 106). In this regard, the second remote control 24 may be electrically independent of the first remote control 2.

Interpretation

The term "television" can be referred to as TV, tv, and the like. The term "streaming media player" can be referred to as media player, streaming player, digital media player, and the like. As well, the term "remote control" can be referred to as remote, remote control device, and the like. In regards to the term "streaming media player remote control," this term can be referred to as Bluetooth remote, Bluetooth remote control, streaming media player remote, and the like.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The invention claimed is:

1. A remote control system comprising:

a first remote control having a front side comprising a first button to wirelessly control a first device, the first remote control having a backside comprising a battery access opening to enable replacing a first battery, wherein a first battery cover not having remote control capability comprises a first protrusion defining a first profile configured to couple the first battery cover to the backside; and a second battery cover mechanically coupled to the battery access opening, the second battery cover comprising a second remote control having a second button to wirelessly control a second device, wherein the second battery cover comprises a second protrusion defining a second profile configured to couple the second battery cover to the backside, wherein the first profile matches the second profile such that the first battery cover is replaced by the second battery, and wherein the second button faces opposite the first button.

2. The remote control system of claim 1, wherein the first device is a streaming media player.

3. The remote control system of claim 1, wherein the second device is a television.

4. The remote control system of claim 1, wherein the first remote control comprises a radio remote control and the second remote control comprises an infrared remote control.

5. The remote control system of claim 1, wherein the first remote control comprises a Bluetooth remote control and the second remote control comprises an infrared remote control.

6. The remote control system of claim 1, wherein the second battery cover protrudes away from the front side of the first remote control such that the backside is thickest in a region of the remote control system that includes the second battery cover, wherein the second battery cover comprises an infrared light oriented forward to emit light along a portion of the backside of the first remote control that does not include the second battery cover.

7. The remote control system of claim 1, wherein the first remote control defines a first width that extends along a first direction and the second remote control defines a second width that extends along the first direction, and wherein the first width is equal to the second width.

8. A remote control system comprising:

a first remote control having a front side comprising a first button to wirelessly control a first device, the first remote control having a backside comprising a battery access opening to enable replacing a first battery, wherein the first remote control comprises indentations configured to couple a first battery cover that does not comprise remote control capabilities to the first remote control; and a second battery cover mechanically coupled to the battery access opening, the second battery cover comprising a second remote control having a second button to wirelessly control a second device, wherein a first protrusion and a second protrusion of the second remote control are mechanically coupled to the indentations of the first remote control to mechanically couple the second remote control to the first remote control, wherein the second remote control is not communicatively coupled to the first remote control, wherein the second battery cover comprises an outer housing that surrounds at least a majority of the second remote control that comprises at least a second button configured to wirelessly control the second device whereby the second button is located on the backside while the first button of the first remote control is located on the front side, and wherein the second battery cover comprises a light emitting diode and a printed circuit board that are not electrically coupled to the first remote control.

9. The remote control system of claim 8, wherein the first remote control is powered by the first battery that defines a first battery type, and the second remote control is powered by a second battery that defines a second battery type, and wherein the first battery type is different from the second battery type.

10. The remote control system of claim 8, wherein the second battery cover is removably coupled to the first remote control.

* * * * *